US006000328A

United States Patent [19]

Mareiniss

[11] Patent Number: 6,000,328

[45] Date of Patent: Dec. 14, 1999

[54] GLOSS CONTROL SYSTEM USING AIR JETS

[75] Inventor: David J. Mareiniss, Portland, Me.

[73] Assignee: Impact Systems, Inc., Los Gatos, Calif.

[21] Appl. No.: 09/035,693

[22] Filed: Mar. 5, 1998

[51] Int. Cl.[6] ..... B30B 15/34; D21G 1/00

[52] U.S. Cl. ..... 100/329; 100/333

[58] Field of Search ..... 100/328, 329, 100/331, 332, 333

[56] References Cited

U.S. PATENT DOCUMENTS

| | | | |
|---|---|---|---|
| 3,190,212 | 6/1965 | Moore | 100/332 |
| 3,770,578 | 11/1973 | Spurrell | 100/329 |
| 4,114,528 | 9/1978 | Walker | 100/333 |
| 4,748,906 | 6/1988 | Ashmore | 100/333 |
| 4,823,688 | 4/1989 | Wedel et al. | 100/328 |
| 5,289,766 | 3/1994 | Conrad et al. | 100/329 |
| 5,533,443 | 7/1996 | Stotz et al. | 100/332 |

*Primary Examiner*—Stephen F. Gerrity
*Attorney, Agent, or Firm*—Flehr Hohbach Test Albritton & Herbert LLP

[57] ABSTRACT

A gloss control system especially for use on a super calender roll system uses controllable jets of heated air arranged along the segment of a calender roll not in contact with a paper web to both control the overall gloss level and equalize the expansion and contraction of the roll which would otherwise be affected by the heat sink effect of the paper on the contacted portion of the roll causing an hour-glass effect. The air jet units utilize electrical heating elements and are actually arranged along, for example, 1½ inch zones of the paper to provide for a differential profile control with relatively cold air on the uncovered ends of the calender roll to compensate for contraction of the center portion of the roll.

5 Claims, 3 Drawing Sheets

GLOSS CONTROL SYSTEM USING AIR JETS

The present invention is directed to a gloss system using air jets and more specifically where the air jets are directed toward the uncovered surface of an associated calender roll.

BACKGROUND OF THE INVENTION

In the production of paper a surface gloss is produced depending on the type of paper; for example, magazine or newsprint. In the paper production process calendering rolls impart a gloss to the surface of the moving paper web. The surface of the calender roll is a hard cylindrical material (steel) and by the use of heat and pressure, the range of gloss development is controlled.

To supply heat to the calender roll or the associated paper web two techniques have been used; direct steam applied to the paper web (for example, see U.S. Pat. No. 4,786,529) or internal heating of the steel calender roll itself by, for example, by inductive coils or the flow of hot oil. By control of such heating, the latex coating on the paper is plasticized and by varying such plasticizing the degree of gloss development is controlled.

In general terms, the surface of the polished metal calender roll is replicated. In the above processes, the application of steam creates too much moisture which affects other parameters of the paper, such as thickness, basic weight, moisture content, etc. The oil or inductive coil technique is very slow. Also in the stream of the paper making process where a super calender roll is used (this is to promote and increase the range of gloss development), normally the steel rolls, which may be 8 or 10 stacked on top of each other commingled with pressure and idler rolls, do not have internal access.

The above '529 patent points up out the problem of inaccurate cross direction control, thus causing a non-uniform cross direction gloss profile. However, another more major problem is that since a portion of the calender roll is covered by the paper, the web in effect cools the contacted portion of the calender roll more than the uncovered ends. The calender roll itself has unequal expansion or contraction of its diameter to produce an hour-glass type shape. In other words, due to the cooling effect of the paper web, the center portion of the roll which is covered by the paper web is of a lesser diameter. This means that the pressure of the adjacent roll (for example, made of artificial material such as NOMEX™) is less in the the center than towards the ends of the calender roll. Unwanted changes both in gloss and thickness (caliper) may also occur. In other words, the greater diameter of the outer edges increases the pressure and calendering effect.

OBJECTS AND SUMMARY OF INVENTION

It is an object of the present invention to provide an improved gloss control system.

A specific object of the invention is to provide a gloss control system where the cross direction thickness of the web is unaffected by the gloss control. In accordance with the above object there is provided a gloss control system having at least one calender roll rotatable about its axis having a hard cylindrical surface for storing heat and where a moving web of calenderable material is in contact with a segment of said cylindrical surface and pressed against such surface by an adjacent roll. The width of the web is less than the axial length of the calender roll to leave the two ends of the calender roll not covered by the web. The system comprises a plurality of air jet means in close proximity to a segment of the cylindrical surface of the calender roll, not in contact with the moving web, arranged along a plurality of zones in the direction of the roll axis, for directing air at said roll surface along its entire axis including means for selectively heating or cooling the air jets from zone to zone.

DETAIL DESCRIPTION OF PREFERRED EMBODIMENT

Figure 1:
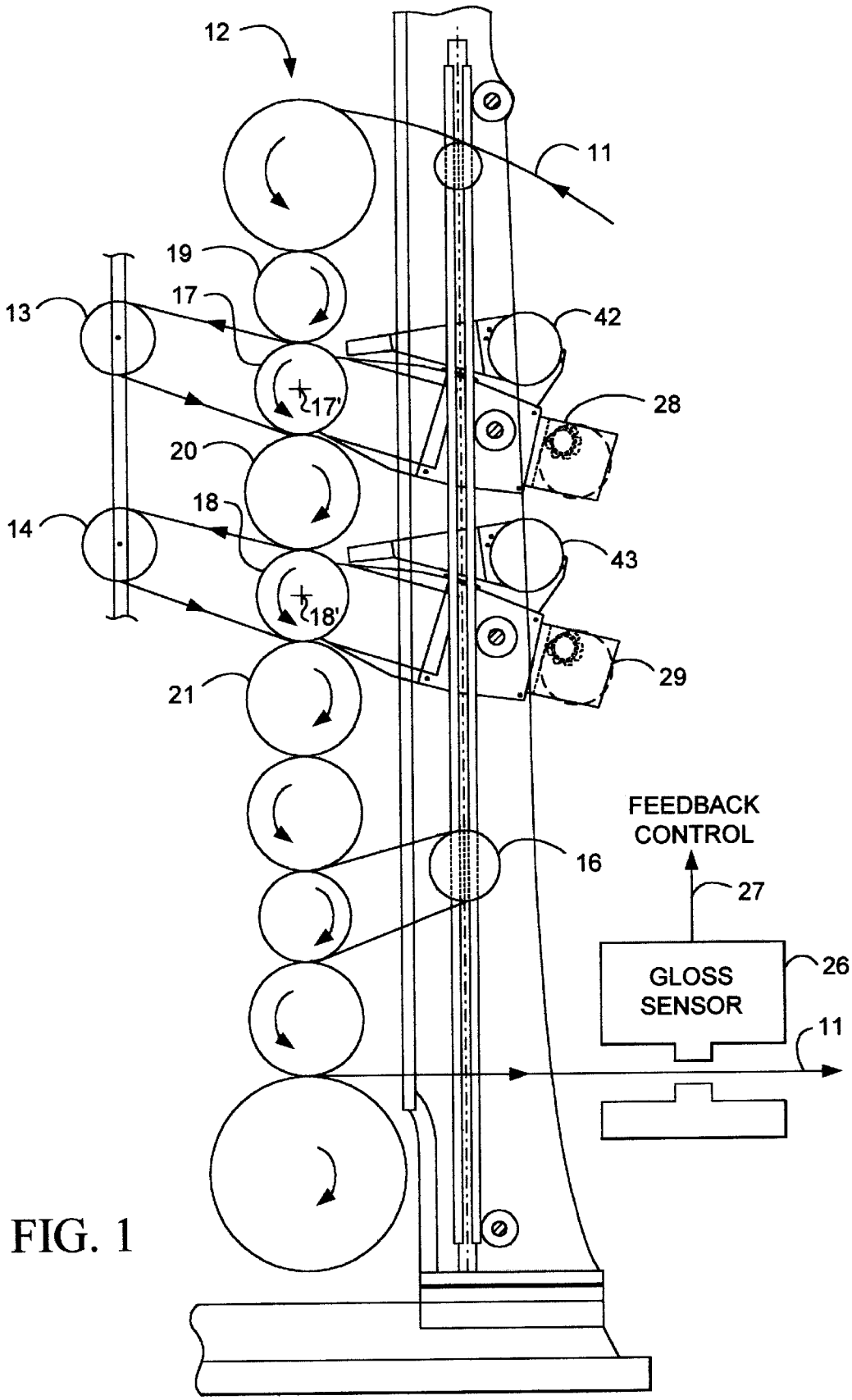
FIG. 1 is a side plan view illustrating a system of calender rolls for the control of gloss which incorporates the present invention.

FIG. 1 illustrates what is termed in the paper industry a super calender system of rolls. A web of calenderable material such as paper 11 is fed into the vertical stack of rolls 12, and the paper passes between the rolls in a general S-path configuration being interrupted by idler rolls 13, 14 and 16. The vertical roll stack 12 consists of two types of rolls—first are normal calender rolls such as 17 and 18 having a hard highly polished cylindrical surface generally of steel, which effectively stores heat, and then adjacent rolls to the steel rolls such as 19, 20 and 21, which are softer rolls, for example, being made of an artificial substance such as NOMEX™. By the application of heat and pressure to the roll itself and/or the surface of the paper, the gloss of the paper is controlled. In general, in a super calender system, the rolls 12 have no internal access. Thus, for example, heat is applied to the paper web 11 adjacent to the roll by a separate steam unit such as disclosed in the above '529 patent. Where inductive heating or hot oil is used, this would be another calendering segment of the paper making process normally upstream from the present super calender system. As the paper web 11 exits the rolls, the gloss sensor unit 26 provides a feedback control signal 27 to indicate whether the heat supplied to the system must be increased or decreased to change the gloss level. And, of course, normally such heat control would in a super calender system control steam units or in an upstream mode the more normal calender gloss unit having internal heating.

However, in accordance with the present invention, heat is applied to the segment of both rolls 17 and 18 (not in contact with paper web 11) indicated by 17' and 18', by a pair of air jet units 28 and 29 mounted in close proximity to the segments 17' and 18'.

Figure 2:
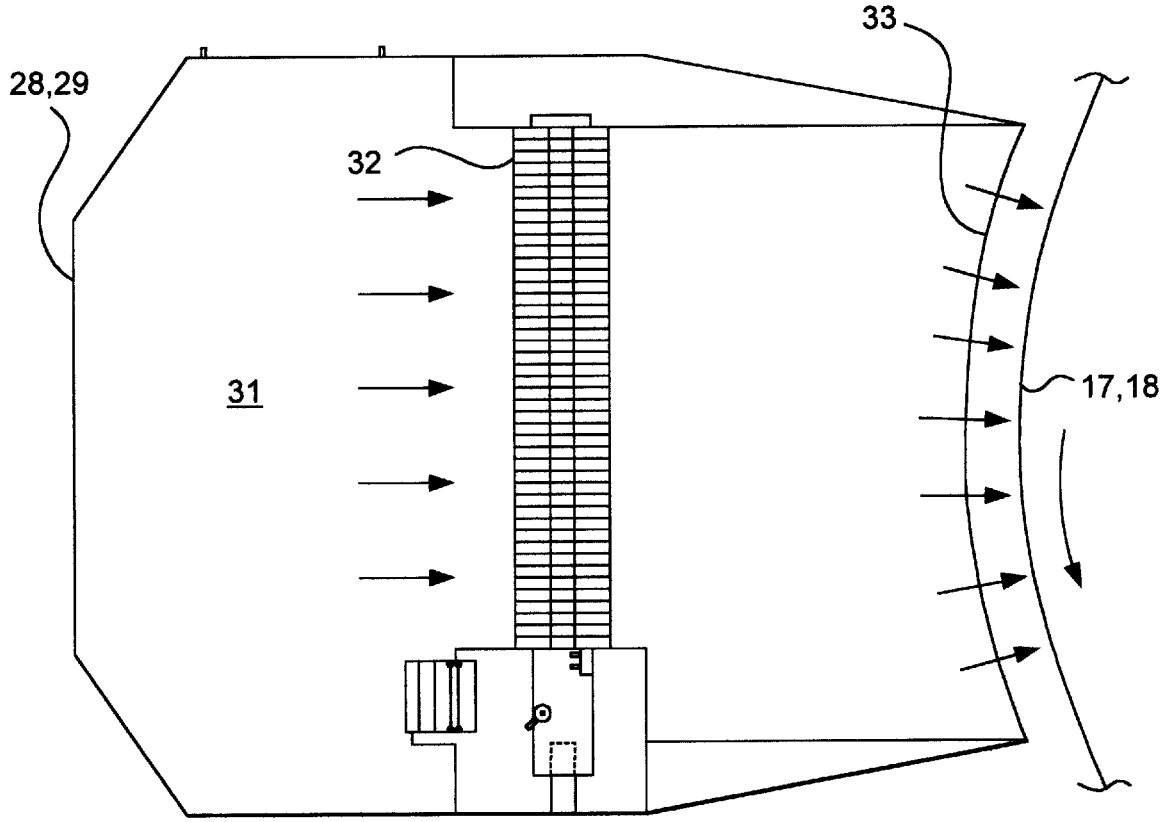
FIG. 2 is a simplified cross-sectional view of an air jet portion of FIG. 1.

FIG. 2 is a simplified end view of the air jet units which are disclosed and claimed fully in U.S. Pat. No. 4,573,402, assigned to the present assignee. The air jet units are sold under the trademark THERMA-JET. Generally such units are used for controlling the caliper of the web of paper by controlling the temperature of air impinging on an adjacent calender roll. Here the expansion of the calender roll is changed to directly affect the thickness or caliper of the paper. Referring specifically to FIG. 2, the air jet unit has a plenum chamber 31 where air from an ambient source is taken in and then passed through individually controlled electrical heating elements 32 mounted in close proximity to a curved apertured faceplate 33. This is then placed adjacent the uncontacted segments 17' or 18' of the calender roll indicated in FIG. 1.

Figure 3:
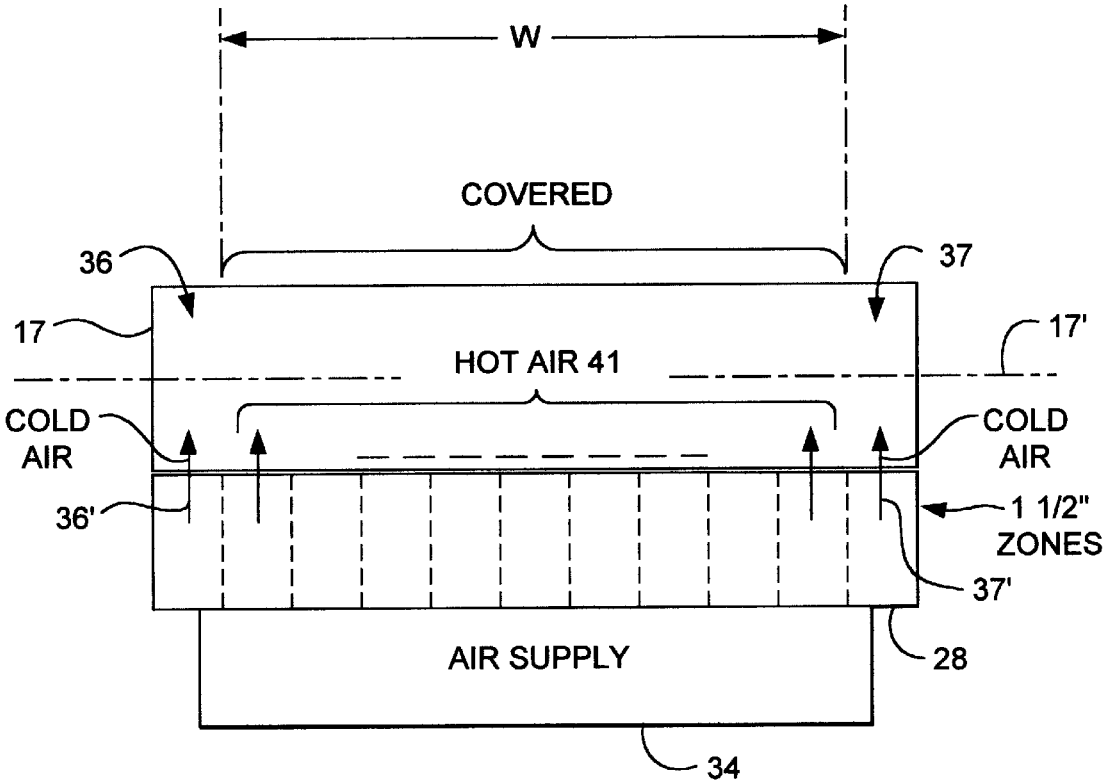
FIG. 3 is a simplified schematic view of a portion of FIG. 1 showing the air jet system of FIG. 2 impinging upon a calender roll.

FIG. 3 illustrates the longitudinal arrangement of the air jet unit 28 which extends along a plurality of zones in the direction of the roll axis 17' of roll 17.

Each zone, depending on the design of the air jet unit, may be, for example, 1½ inches wide and contain 1 or 2 individually controlled heating elements 32. The ambient air supply at 34 is indicated. The air is directed along the entire axis 17' of the roll including ends 36 and 37 not covered by the paper web.

Figure 4:
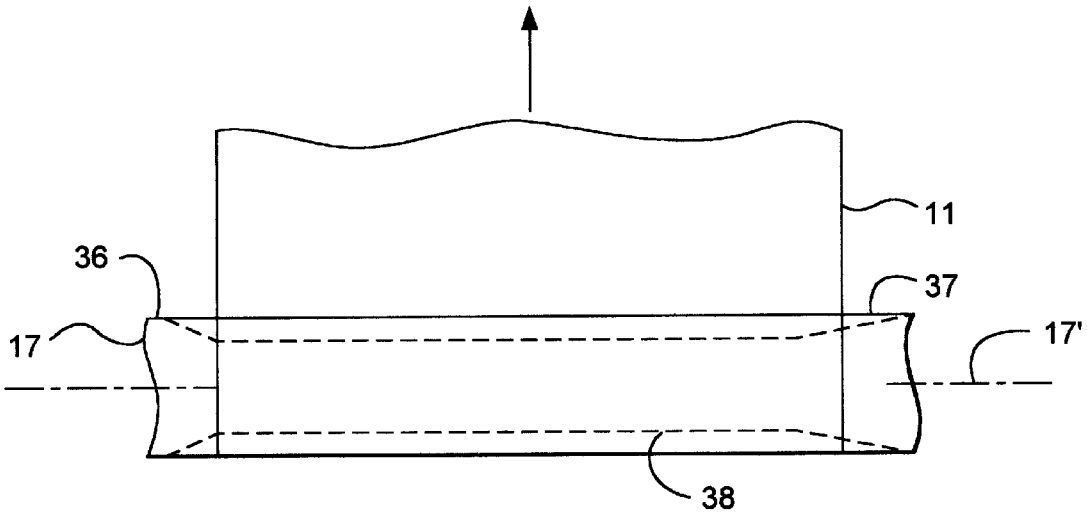
FIG. 4 is a plan view of the same calender roll but from a different viewpoint showing how a paper web moves across it and illustrating the effects of prior art rolls in dashed outline.

FIG. 4 shows the paper web 11 as having a width W as it would contact another segment of roll 17. This is looking down on the roll as it is shown in FIG. 1. As explained above, the paper web 11 tends to cool steel roll 17 to thus cause a contraction in its diameter, except at the uncovered ends 36 and 37, to produce an hourglass shape indicated by the dashed lines 38. As discussed above, this is undesirable in causing larger diameter ends of the roll to affect the paper thickness making the profile uneven and also the gloss. It is desired to equalize expansion or contraction of the diameter of the roll along its entire axis 17' both covered and uncovered.

To accomplish this, as illustrated in FIG. 3, the air jet units 28 for the uncovered end sections 36 and 37 provide relatively cold air indicated by the arrows 36' and 37' to thus simulate the cooling effect of the paper web 11. The air jet units 28 because of the individually controlled heating elements 32, shown in FIG. 2, can easily accommodate this temperature difference.

And specifically, in a practical application, the cold air supplied at 36' and 37' is actually unheated air (or minimally heated) and the remainder of the air designated hot air 41, heats the surface of the calender roll 17 to a desired temperature to produce the desired gloss. This can either be done on a cross direction zone by zone basis or in a more typical case the hot air 41 temperature would be the same along the entire width W of the web 11. In any case, the feedback control is used to control the surface temperature and heat stored by the roll to thereby control the transfer of heat from the calender roll to the web to control its gloss. Gloss is controlled, for example, by plasticizing the surface at approximately a temperature of 160° F.

As illustrated in FIGS. 3 and 4 the width, W, of paper web 11 may be typically 95% of the entire axial length of roll 17. However, depending on the paper being produced, the width may be as little as 50% of the axial length. Nevertheless, the air jet units 28 may easily compensate in the same manner since the air jets are divided into individually controlled heating zones. And the relatively cold air at the uncovered ends may be precisely controlled on an axial basis.

As illustrated in FIG. 2, the use of electrical heating elements in close proximity to the rolls 17 and 18 allows accurate differential control of the air jet temperature. Also as illustrated in FIG. 1, for heat recovery suction units 42, 43 associated with air jet units 28, 29 are used to provide recirculation of the heated air.

Thus in summary the present system, especially in the context of super calender rolls where no internal access of a calender roll is available, allows more effective control of gloss in general either with or without specific cross direction control. This is an improvement over steam units which have moisture problems. In addition it is an improvement where access is available over internally heated rolls heated either by internal induction or oil which is very slow. Finally the hourglass problem is corrected.

Thus an improved gloss control system has been provided which is easily adapted to existing paper processing. And moreover for the first time the cross direction thickness of the web is unaffected and immunized from changes in the gloss parameter.

What is claimed is:

1. A gloss control system having at least one calender roll rotatable about its axis having a hard metallic cylindrical surface for storing heat and where a moving web of calenderable material is in contact with a segment of said cylindrical surface and pressed against said surface by an adjacent roll, the width of said web being less than the axial length of said calender roll to leave the two ends of the calender roll not covered by said web, said system comprising:

a plurality of air jet means in close proximity to a segment of said cylindrical surface of said calender roll, not in contact with said moving web, arranged along a plurality of zones in the direction of said roll axis, for directing air at said roll surface along its entire axis including means for selectively heating or cooling said air jets from zone to zone, said air jet means for said zones of said uncovered ends of said roll providing relatively cool air compared to the covered segment of such roll to equalize expansion or contraction of the diameter of said roll along its entire axis.

2. A gloss control system as in claim 1 including feedback control means for sensing in a cross-direction the gloss value of said web where said air jet means heat said roll surface to control the transfer of heat to said calenderable web to control said gloss value in a cross direction.

3. A gloss control system as in claim 1 where said air jet means include a plurality of electrical heating elements in close proximity to said calender roll.

4. A gloss control system as in claim 1 where said calender roll has no internal access.

5. A gloss control system as in claim 1 where the cross direction thickness of said web is unaffected by said gloss control.

* * * * *